US011897666B2

(12) United States Patent
Hasegawa

(10) Patent No.: US 11,897,666 B2
(45) Date of Patent: Feb. 13, 2024

(54) PACKAGE

(71) Applicant: NIPRO CORPORATION, Osaka (JP)

(72) Inventor: Mitsuru Hasegawa, Osaka (JP)

(73) Assignee: NIPRO CORPORATION, Osaka (JP)

( * ) Notice: Subject to any disclaimer, the term of this patent is extended or adjusted under 35 U.S.C. 154(b) by 334 days.

(21) Appl. No.: 17/295,694

(22) PCT Filed: Sep. 27, 2019

(86) PCT No.: PCT/JP2019/038169
§ 371 (c)(1),
(2) Date: Sep. 14, 2021

(87) PCT Pub. No.: WO2020/105280
PCT Pub. Date: May 28, 2020

(65) Prior Publication Data

US 2023/0159233 A1 May 25, 2023

(30) Foreign Application Priority Data

Nov. 22, 2018 (JP) ..... 2018-219233

(51) Int. Cl.
*B65D 43/22* (2006.01)
*B65D 43/16* (2006.01)

(52) U.S. Cl.
CPC ..... *B65D 43/22* (2013.01); *B65D 43/162* (2013.01); *B65D 2401/05* (2020.05); *B65D 2401/10* (2020.05); *B65D 2401/20* (2020.05)

(58) Field of Classification Search
CPC .. B65D 43/22; B65D 43/162; B65D 2401/15; B65D 2401/10
(Continued)

(56) References Cited

U.S. PATENT DOCUMENTS 4,431,110 A * 2/1984 Roth ..... B65D 47/0838 220/270
5,788,105 A * 8/1998 Foos ..... B65D 75/22 206/469
(Continued)

FOREIGN PATENT DOCUMENTS

EP 3819230 A1 * 5/2021 ..... B65D 1/26
FR 2907102 A1 * 4/2008 ..... B65D 43/162
(Continued)

OTHER PUBLICATIONS

International Search Report for PCT/JP2019/038169 dated Dec. 17, 2019 (PCT/ISA/210).

*Primary Examiner* — James N Smalley
(74) *Attorney, Agent, or Firm* — Sughrue Mion, PLLC

(57) ABSTRACT

A package includes a first side, a second side and a hinge. As the first side and the second side pivot around the hinge, the first side and the second side make transition between a closed state and an opened state. The first side includes a first fitting portion in a projecting shape, a rigid portion provided in a partial section on a line that goes around the first fitting portion, and a first weak portion provided in a remaining section on the line that goes around the first fitting portion and being lower in rigidity than the rigid portion. The second side includes a second fitting portion in a recessed shape and fitted to the first fitting portion in the closed state and a second weak portion provided on a line that goes around the second fitting portion and being lower in rigidity than the rigid portion.

7 Claims, 10 Drawing Sheets

(58) Field of Classification Search
USPC ..... 220/833–835, 839
See application file for complete search history.

(56) References Cited

U.S. PATENT DOCUMENTS

| | | | | |
|---|---|---|---|---|
| 7,717,267 | B2 * | 5/2010 | Applebaum | B65D 73/0014 206/464 |
| 2006/0213800 | A1 * | 9/2006 | Ballard | B65D 43/162 229/407 |
| 2007/0045317 | A1 * | 3/2007 | Rosender | B65D 43/0249 220/4.23 |
| 2010/0072217 | A1 * | 3/2010 | Parikh | B65D 55/024 220/833 |
| 2010/0181222 | A1 | 7/2010 | Aiko et al. | |
| 2011/0000929 | A1 * | 1/2011 | Brown | B65D 43/162 220/810 |
| 2012/0103990 | A1 * | 5/2012 | McCumber | B65D 41/165 220/270 |
| 2013/0160406 | A1 * | 6/2013 | Johnston | B65B 7/26 220/268 |
| 2015/0083725 | A1 * | 3/2015 | Sinha | B65D 43/163 220/283 |
| 2017/0121080 | A1 * | 5/2017 | Wang | B65D 43/0254 |
| 2020/0239208 | A1 * | 7/2020 | Lam | B65D 55/024 |
| 2023/0017604 | A1 * | 1/2023 | Parikh | B65D 43/0235 |

FOREIGN PATENT DOCUMENTS

| | | | | |
|---|---|---|---|---|
| GB | 2239866 | A * | 7/1991 | B65D 43/0237 |
| JP | 2006-256651 | A | 9/2006 | |
| JP | 2008-222286 | A | 9/2008 | |
| JP | 2010-168073 | A | 8/2010 | |
| JP | 2013-100121 | A | 5/2013 | |
| WO | WO-2005082733 | A1 * | 9/2005 | B65D 43/021 |

* cited by examiner

PACKAGE

CROSS REFERENCE TO RELATED APPLICATIONS

This application is a National Stage of International Application No. PCT/JP2019/038169 filed Sep. 27, 2019, claiming priority based on Japanese Patent Application No. 2018-219233 filed Nov. 22, 2018.

TECHNICAL FIELD

This invention relates to a package.

BACKGROUND ART

For example, Japanese Patent Laying-Open No. 2006-256651 (PTL 1) discloses a packaging container including a first package and a second package in which a merchandise can be accommodated, a male portion provided in any one of the first package and the second package, and a female portion provided in any the other of the first package and the second package and coupled to the male portion in sealing. The first package or the second package is provided with a weak portion for separating, at the time of opening, the male portion or the female portion from the package while coupling between the male portion and the female portion is held.

CITATION LIST

Patent Literature

PTL 1: Japanese Patent Laying-Open No. 2006-256651

SUMMARY OF INVENTION

Technical Problem

In order to readily confirm the fact of malicious opening of the packaging container, the packaging container disclosed in PTL 1 described above is constructed such that the weak portion is broken at the time of opening of the packaging container while coupling between the male portion and the female portion is held. According to such a construction, however, force produced when the weak portion is broken at the time of opening of the packaging container may greatly deform the packaging container. In this case, excessive force is applied to the merchandise accommodated in the packaging container or the merchandise falls from the packaging container. The merchandise thus cannot properly be protected.

Then, an object of this invention is to solve the problem above, and to provide a package that allows subsequent confirmation of the fact of opening while it properly protects an article accommodated therein.

Solution to Problem

A package according to this invention is a package formed from a flexible sheet material. The package includes a first side and a second side and a hinge that foldably connects the first side and the second side to each other. The first side and the second side make transition between a closed state and an opened state by pivoting around the hinge. In the closed state, a space for accommodating an article is provided. In the opened state, the space is opened. The first side includes a first fitting portion in any one of a projecting shape and a recessed shape, a rigid portion provided in a partial section on a line that goes around the first fitting portion, and a first weak portion provided in a remaining section on the line that goes around the first fitting portion and being lower in rigidity than the rigid portion. The second side includes a second fitting portion in any the other of the projecting shape and the recessed shape and fitted to the first fitting portion in the closed state and a second weak portion provided on a line that goes around the second fitting portion and being lower in rigidity than the rigid portion.

Advantageous Effects of Invention

According to this invention, a package that allows subsequent confirmation of the fact of opening while it properly protects an article accommodated therein can be provided.

DESCRIPTION OF EMBODIMENTS

Figure 1:
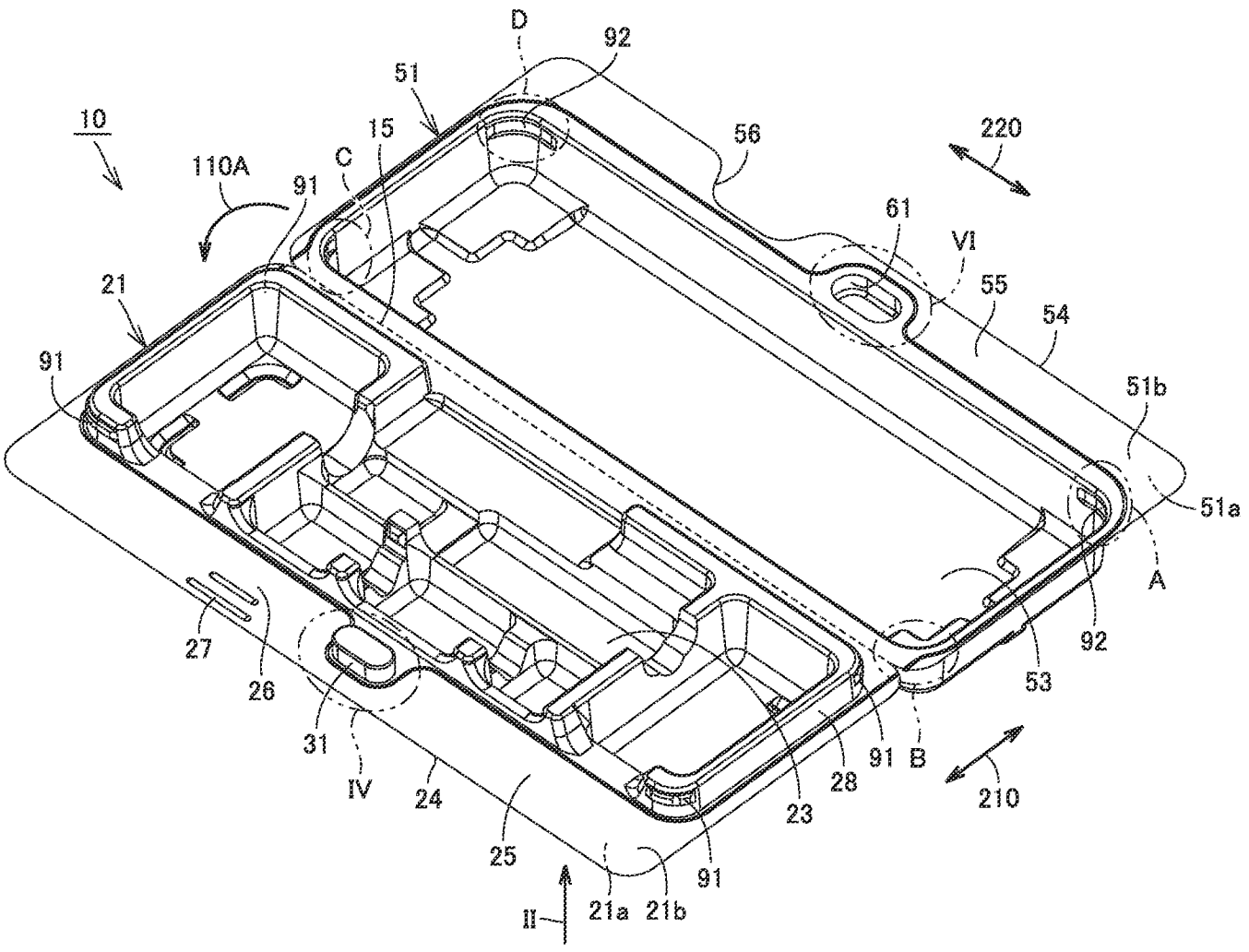
FIG. 1 is a perspective view showing a package (unused) in an embodiment of this invention.

An embodiment of this invention will be described with reference to the drawings. The same or corresponding members in the drawings referred to below have the same reference characters allotted.

Figure 2:
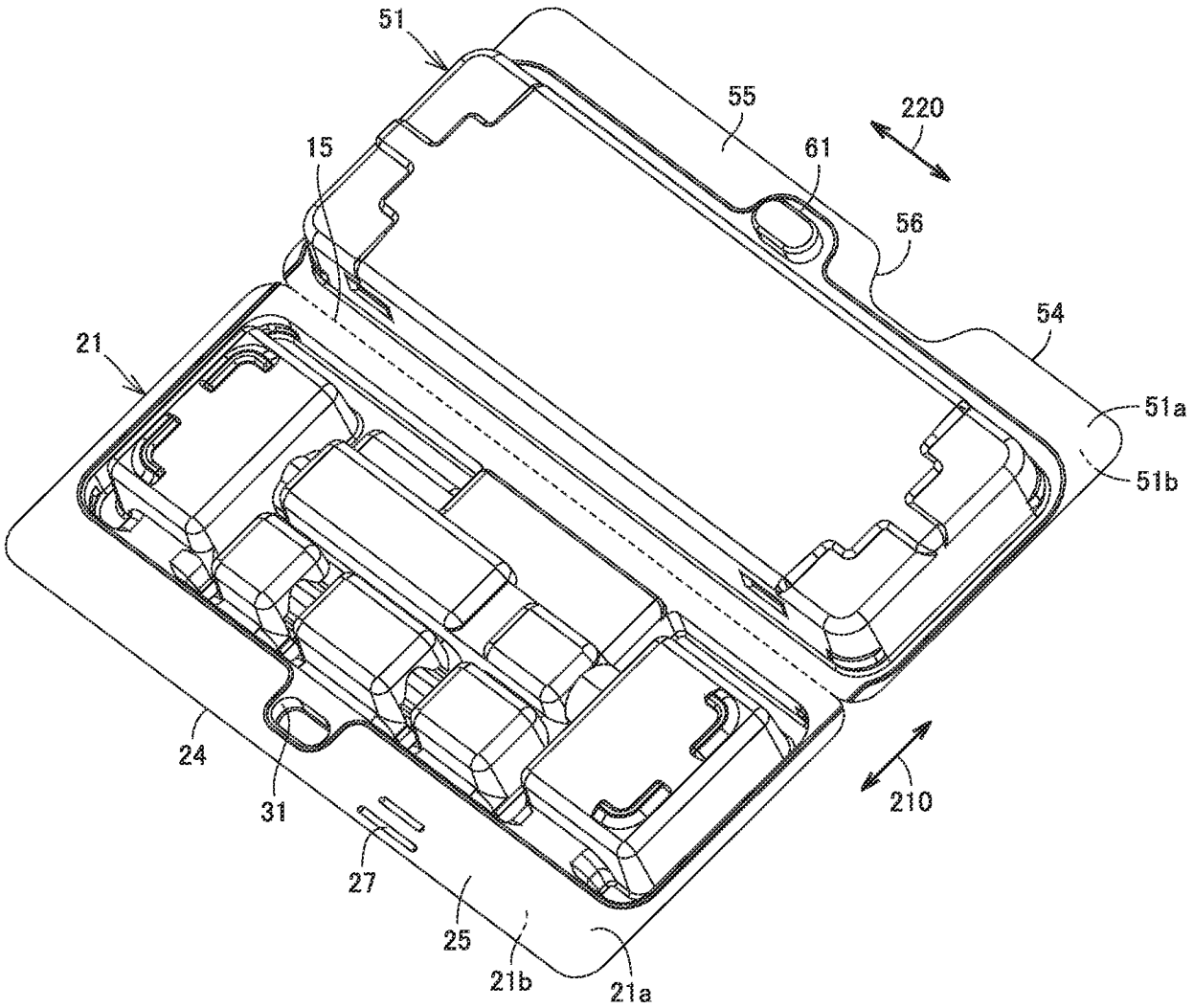
FIG. 2 is a perspective view showing the package (unused) in a direction shown with an arrow II in FIG. 1.
Figure 3:
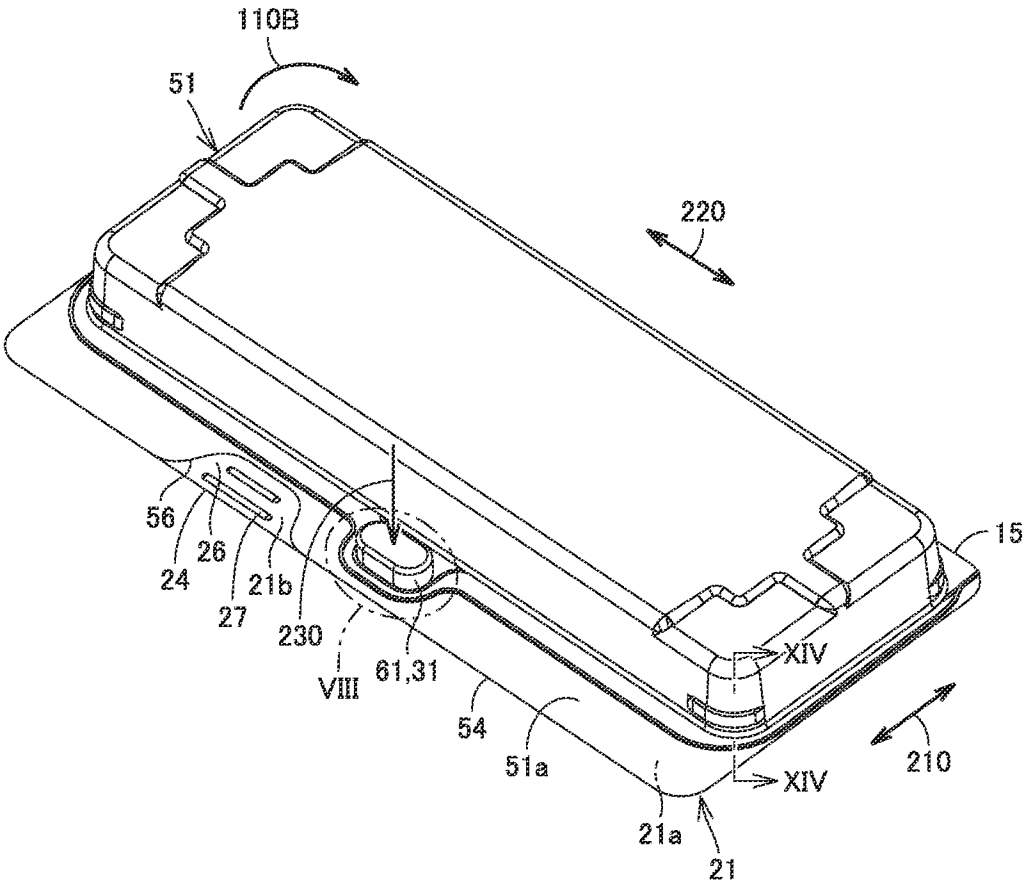
FIG. 3 is a perspective view showing the package (closed) in the embodiment of this invention.

FIG. 1 is a perspective view showing a package (unused) in an embodiment of this invention. FIG. 2 is a perspective view showing the package (unused) in a direction shown with an arrow II in FIG. 1. FIG. 3 is a perspective view showing the package (closed) in the embodiment of this invention.

Referring to FIGS. 1 to 3, a package 10 in the present embodiment is a container for accommodating a medical product in which a drug has been loaded. More specifically, package 10 is a container for accommodating a double chamber type prefilled syringe.

Package 10 is formed from a flexible sheet material. Package 10 is formed from a sheet material made of a resin.

Package 10 includes a first side 21, a second side 51, and a hinge 15. Hinge 15 foldably connects first side 21 and second side 51 to each other. By pivoting around hinge 15, first side 21 and second side 51 make transition between a closed state in which a space for accommodating a syringe is provided (a state shown in FIG. 3) and an opened state (a state shown in FIGS. 1 and 2) in which the space is opened.

First side 21 is in a rectangular two-dimensional shape. First side 21 is in such a rectangular two-dimensional shape that a direction shown with an arrow 210 is defined as a short-side direction and a direction shown with an arrow 220 is defined as a longitudinal direction. First side 21 includes a first surface 21*a* and a second surface 21*b*. First surface 21*a* is arranged to face an outer space in the closed state. Second surface 21*b* is arranged on a rear side of first surface 21*a*.

Second side 51 is in a rectangular two-dimensional shape. Second side 51 is in such a rectangular two-dimensional shape that the direction shown with arrow 210 is defined as the short-side direction and the direction shown with arrow 220 is defined as the longitudinal direction. Second side 51 includes a third surface 51*a* and a fourth surface 51*b*. Third surface 51*a* is arranged to face the outer space in the closed state. Fourth surface 51*b* is arranged on a rear side of third surface 51*a*. Second surface 21*b* and fourth surface 51*b* face each other in the closed state.

First side 21 and second side 51 are not limited in shape to the rectangular shape above, and can be in any shape. For the sake of convenience of illustration, the direction (a direction of radius of a pivot center axis of first side 21 and second side 51) shown with arrow 210 is herein referred to as a "short-side direction of first side 21 and second side 51" and the direction (an axial direction of the pivot center axis of first side 21 and second side 51) shown with arrow 220 is referred to as a "longitudinal direction of first side 21 and second side 51."

Hinge 15 extends in the longitudinal direction of first side 21 and second side 51. Hinge 15 is provided along a long side in a plan view of first side 21 and second side 51. Hinge 15 is provided as a perforated portion provided by intermittently cutting the sheet material that forms package 10.

First side 21 is provided with a depression 23. Depression 23 is in a depressed shape on a side of second surface 21*b*. Depression 23 is in a depressed shape in conformity with a shape of a syringe. A syringe is arranged in depression 23.

Second side 51 is provided with a depression 53. Depression 53 is in a depressed shape on a side of fourth surface 51*b*. Together with depression 23, depression 53 defines a space for accommodating a syringe.

In the present embodiment, first side 21 where the syringe is arranged serves as a bottom (a main body) of package 10 and second side 51 that covers the syringe arranged in first side 21 serves as a lid of package 10.

In a general manner of use, as shown in FIG. 1, first side 21 and the second side are set to the closed state as first side 21 is set to a posture in which second surface 21*b* faces up and first surface 21*a* faces down and second side 51 is pivoted around hinge 15 in a direction shown with an arrow 110A. As shown in FIG. 3, package 10 is set to the opened state as second side 51 is pivoted around hinge 15 in a direction shown with an arrow 110B while first side 21 is maintained in the posture in which second surface 21*b* faces up and first surface 21*a* faces down.

First side 21 includes a peripheral portion 24, a flange 25, a hold 26, and a wall 28.

Peripheral portion 24 defines a periphery of the sheet material that forms first side 21 at a position distant in the direction of radius from a pivot center of first side 21 and second side 51 of hinge 15. Peripheral portion 24 extends in the longitudinal direction of first side 21. Peripheral portion 24 extends along the long side in the plan view of first side 21. Peripheral portion 24 is opposed to hinge 15 in the short-side direction of first side 21.

Flange 25 extends like a band along peripheral portion 24. Flange 25 extends in the longitudinal direction of first side 21 over a prescribed width in the short-side direction of first side 21. Flange 25 is provided between peripheral portion 24 and depression 23 in the short-side direction of first side 21.

Hold 26 is a part of flange 25. Hold 26 is a part held by a user mainly when package 10 is opened. Hold 26 is provided with a projection 27. Projection 27 is in a shape projecting on the side of second surface 21*b* and extends in the longitudinal direction of first side 21.

Wall 28 is in a shape of a wall rising from second surface 21*b*. Wall 28 is provided in a partial section of a surrounding path that surrounds depression 23. The surrounding path that surrounds depression 23 is in a rectangular shape. Wall 28 is provided at least at positions including four corners of the rectangular surrounding path. Wall 28 is located within depression 53 in second side 51 in the closed state.

Second side 51 includes a peripheral portion 54 and a flange 55. Peripheral portion 54 defines a periphery of the sheet material that forms second side 51 at a position distant in the direction of radius from the pivot center of first side 21 and second side 51 in hinge 15. Peripheral portion 54 extends in the longitudinal direction of second side 51. Peripheral portion 54 extends along a long side in a plan view of second side 51. Peripheral portion 54 is opposed to hinge 15 in the short-side direction of second side 51.

Flange 55 extends like a band along peripheral portion 54. Flange 55 extends in the longitudinal direction of second side 51 over a prescribed width in the short-side direction of second side 51, except for a position where a notch 56 which will be described later is provided. Flange 55 is provided between peripheral portion 54 and depression 53 in the short-side direction of second side 51. Flange 55 is superimposed on flange 25 of first side 21 in the closed state.

Flange 55 is provided with notch 56. Notch 56 is in a notched shape that opens on a side of peripheral portion 54. Notch 56 is provided to expose hold 26 in first side 21 through flange 55 in the closed state.

Figure 4:
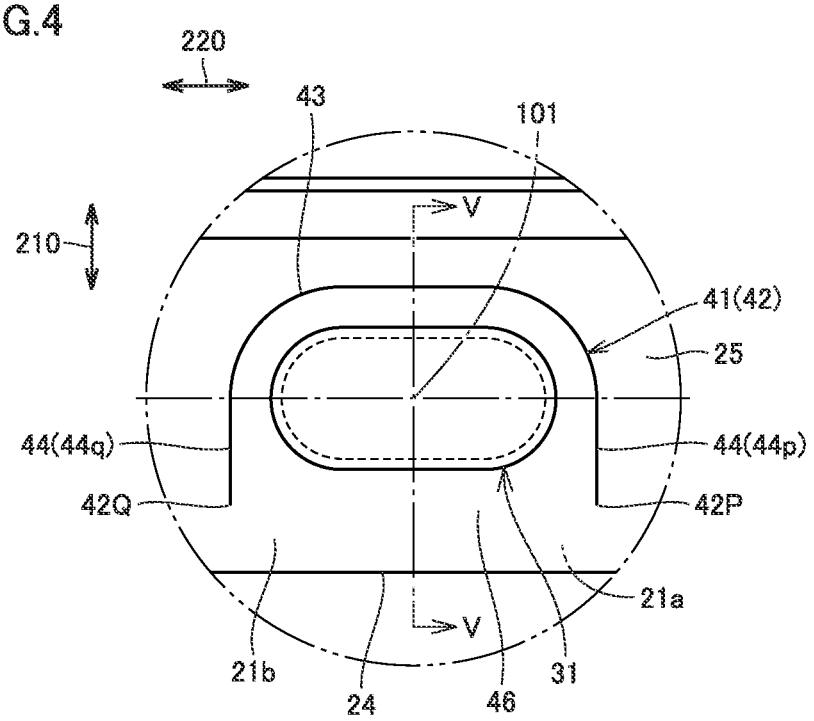
FIG. 4 is a plan view showing a first side within an area surrounded by a chain double-dotted line IV in FIG. 1.
Figure 5:
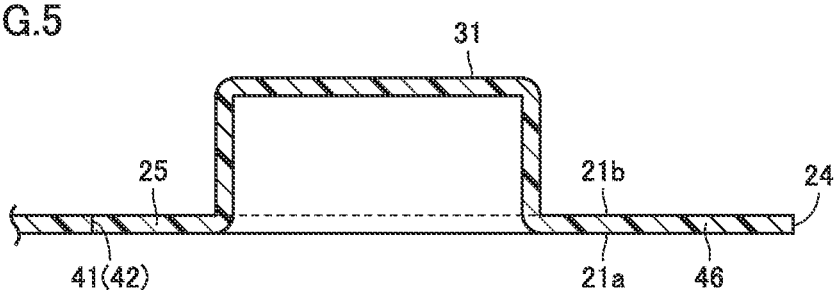
FIG. 5 is a cross-sectional view showing the first side in a direction shown with an arrow V-V in FIG. 4.

FIG. 4 is a plan view showing the first side within an area surrounded by a chain double-dotted line IV in FIG. 1. FIG. 5 is a cross-sectional view showing the first side in a direction shown with an arrow V-V in FIG. 4.

Referring to FIGS. 1 to 5, first side 21 further includes a first fitting portion 31. First fitting portion 31 is in a projecting shape when viewed from second side 51 in the closed state.

First fitting portion 31 is in the projecting shape that projects from second surface 21*b* when viewed from second side 51 in the closed state and in the recessed shape recessed from first surface 21*a* when viewed from the opposite side. First fitting portion 31 is provided in flange 25. First fitting portion 31 is provided at a position adjacent to peripheral portion 24. First fitting portion 31 is provided between peripheral portion 24 and depression 23 in the short-side direction of first side 21. First fitting portion 31 is provided in a central portion in the longitudinal direction of first side 21.

First fitting portion 31 is defined by two straight lines that extend in the longitudinal direction of first side 21, a semicircle that connects one ends of the straight lines to each other, and a semicircle that connects the other ends of the straight lines to each other, and is in a two-dimensional shape like a track with a central axis 101 being defined as the center.

First side 21 further includes a rigid portion 46 and a first weak portion 41. Rigid portion 46 and first weak portion 41 are provided on a line that goes around first fitting portion 31. Rigid portion 46 is provided in a partial section on the line that goes around first fitting portion 31. First weak portion 41 is provided in a remaining section on the line that goes around first fitting portion 31. First weak portion 41 is lower in rigidity than rigid portion 46.

First weak portion 41 is provided as a cut portion 42 provided by continuously cutting first side 21 along the line that goes around first fitting portion 31. Cut portion 42 extends between one end 42P and the other end 42Q. One end 42P and the other end 42Q are located between central axis 101 and peripheral portion 24 in the short-side direction of first side 21.

Cut portion 42 includes an inner portion 43 and a pair of outer portions 44 (44*p* and 44*q*). Inner portion 43 is provided at a position where a length from peripheral portion 24 to inner portion 43 in the short-side direction of first side 21 is equal to or longer than a length from peripheral portion 24 to central axis 101 in the short-side direction of first side 21. Inner portion 43 extends along a perimeter of first fitting portion 31 at a certain distance from first fitting portion 31 in the two-dimensional shape like the track.

The pair of outer portions 44 is provided at positions where a length from peripheral portion 24 to outer portion 44 in the short-side direction of first side 21 is shorter than the length from peripheral portion 24 to central axis 101 in the short-side direction of first side 21. Outer portion 44*p* extends in the short-side direction of first side 21 from one end of inner portion 43 toward one end 42P of cut portion 42. Outer portion 44*q* extends in the short-side direction of first side 21 from the other end of inner portion 43 toward the other end 42Q of cut portion 42.

Rigid portion 46 extends along a virtual straight line that connects one end 42P of cut portion 42 and the other end 42Q of cut portion 42 to each other. First side 21 is not cut on the virtual straight line that connects one end 42P of cut portion 42 and the other end 42Q of cut portion 42 to each other and rigid portion 46 is formed from a non-cut portion of first side 21.

In such a construction, rigidity of first weak portion 41 formed from cut portion 42 is zero and lower than rigidity of rigid portion 46.

Figure 6:
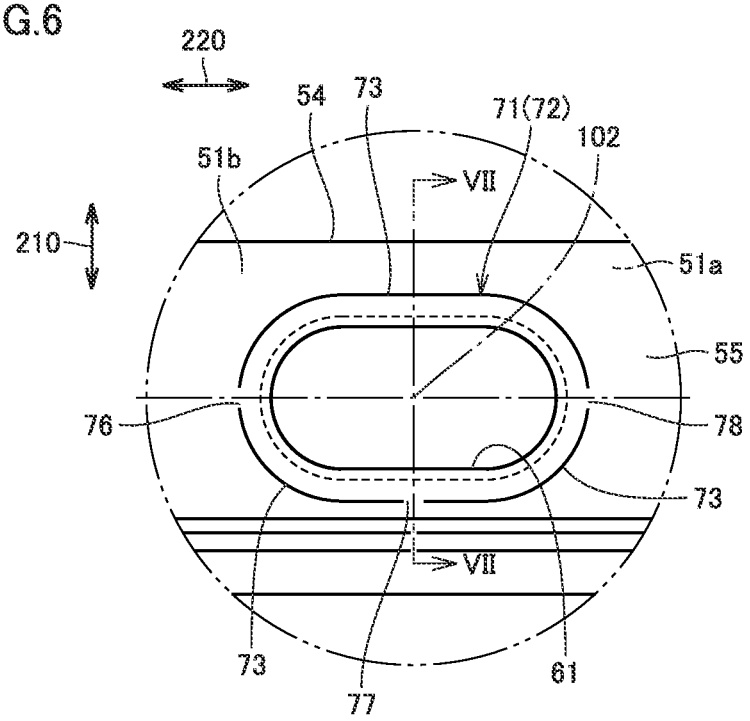
FIG. 6 is a plan view showing a second side within an area surrounded by a chain double-dotted line VI in FIG. 1.
Figure 7:
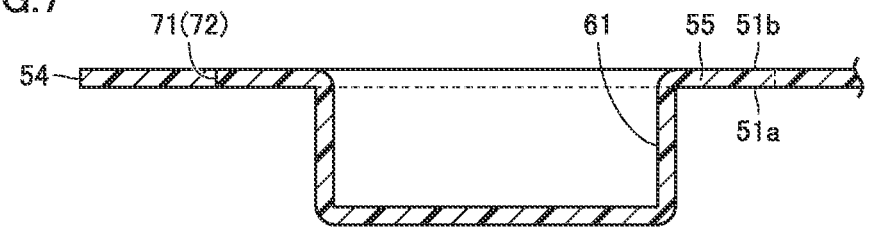
FIG. 7 is a cross-sectional view showing the second side in a direction shown with an arrow VII-VII in FIG. 6.

FIG. 6 is a plan view showing the second side within an area surrounded by a chain double-dotted line VI in FIG. 1. FIG. 7 is a cross-sectional view showing the second side in a direction shown with an arrow VII-VII in FIG. 6.

Referring to FIGS. 1 to 3, 6, and 7, second side 51 further includes a second fitting portion 61. Second fitting portion 61 is in a recessed shape when viewed from first side 21 in the closed state.

Second fitting portion 61 is in the recessed shape recessed from fourth surface 51*b* when viewed from first side 21 in the closed state and in the projecting shape projecting from third surface 51*a* when viewed from the opposite side. Second fitting portion 61 is provided in flange 55. Second fitting portion 61 is provided at a position adjacent to peripheral portion 54. Second fitting portion 61 is provided between peripheral portion 54 and depression 53 in the short-side direction of second side 51. Second fitting portion 61 is provided in the central portion in the longitudinal direction of second side 51.

Second fitting portion 61 is defined by two straight lines that extend in the longitudinal direction of second side 51, a semicircle that connects one ends of the straight lines to each other, and a semicircle that connects the other ends of the straight lines to each other, and is in a two-dimensional shape like a track with a central axis 102 being defined as the center.

Second side 51 further includes a second weak portion 71. Second weak portion 71 is provided along a line that goes around second fitting portion 61. Second weak portion 71 extends along a perimeter of second fitting portion 61 at a certain distance from second fitting portion 61 in the two-dimensional shape like the track.

Second weak portion 71 is provided as a perforated portion 72 provided by intermittently cutting second side 51 along the line that goes around second fitting portion 61.

Perforated portion 72 includes a cut portion 73 and non-cut portions 76, 77, and 78. Cut portion 73 is a part where second side 51 is cut in perforated portion 72. Non-cut portions 76, 77, and 78 are parts where second side 51 is not cut in perforated portion 72. Cut portion 73 and non-cut portions 76, 77, and 78 are alternately aligned on the line that goes around second fitting portion 61 to thereby provide perforated portion 72.

Cut portion 73 is longer in total length than non-cut portions 76, 77, and 78. Non-cut portion 76 and non-cut portion 78 are located on respective opposing sides of second fitting portion 61 in the longitudinal direction of second side 51. Non-cut portion 77 is located between second fitting portion 61 and depression 53 in the short-side direction of second side 51. Non-cut portion 77 is located in the central portion between non-cut portion 76 and non-cut portion 78 in the longitudinal direction of second side 51.

In such a construction, second weak portion 71 formed from perforated portion 72 is lower in rigidity than rigid portion 46. Second weak portion 71 formed from perforated portion 72 is higher in rigidity than first weak portion 41 formed from cut portion 42.

Figure 8:
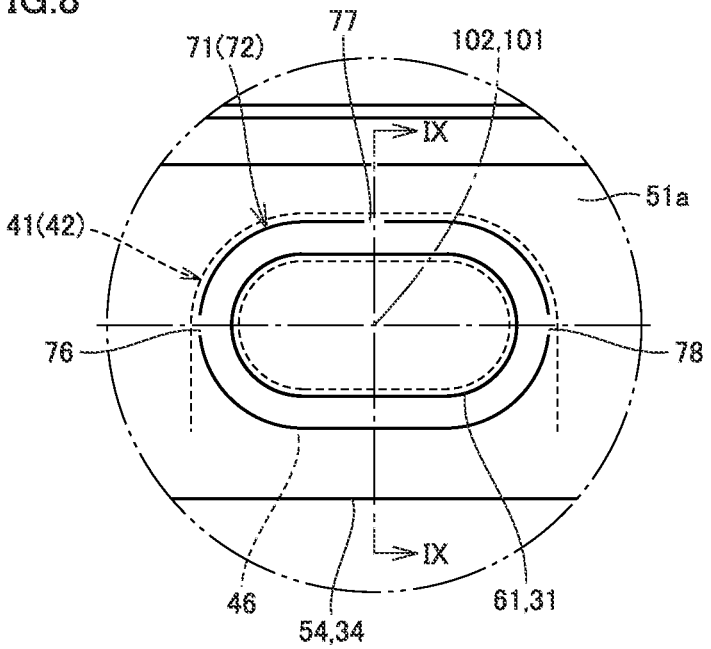
FIG. 8 is a plan view showing the first side and the second side within an area surrounded by a chain double-dotted line VIII in FIG. 3.
Figure 9:
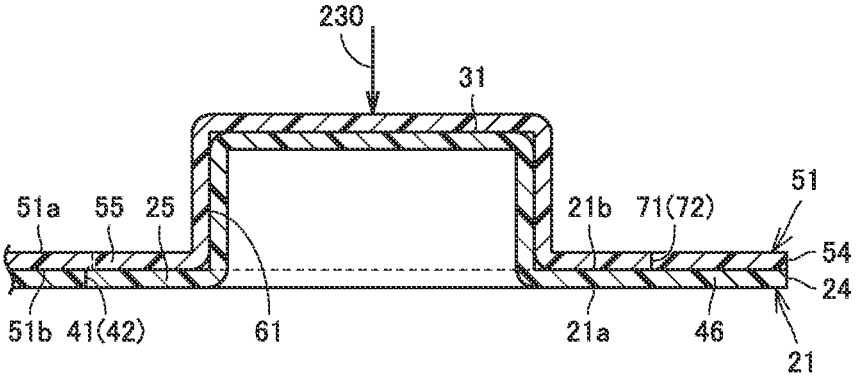
FIG. 9 is a cross-sectional view showing the first side and the second side in a direction shown with an arrow IX-IX in FIG. 8.

FIG. 8 is a plan view showing the first side and the second side within an area surrounded by a chain double-dotted line VIII in FIG. 3. FIG. 9 is a cross-sectional view showing the first side and the second side in a direction shown with an arrow IX-IX in FIG. 8.

Referring to FIGS. 3, 8, and 9, in the closed state, first fitting portion 31 and second fitting portion 61 are fitted to each other.

More specifically, first fitting portion 31 in the projecting shape that projects from second surface 21*b* is fitted to an inner side of second fitting portion 61 in the recessed shape recessed from fourth surface 51*b*. As first fitting portion 31 and second fitting portion 61 are fitted to each other, package 10 is closed. Owing to a fitting structure of first fitting portion 31 and second fitting portion 61, the closed state of package 10 can be obtained without using an adhesive. While first fitting portion 31 and second fitting portion 61 are fitted to each other, central axis 101 of first fitting portion 31 and central axis 102 of second fitting portion 61 are coaxially arranged.

As shown in FIG. 8, in the closed state, non-cut portions 76, 77, and 78 in perforated portion 72 are arranged as being superimposed on an area from first fitting portion 31 to first weak portion 41 (cut portion 42) on the surface of first side 21. Non-cut portions 76, 77, and 78 in perforated portion 72 are arranged on a line of first weak portion 41 (cut portion 42) or on an inner side of first weak portion 41 (cut portion 42) when viewed from central axes 101 and 102.

Figure 10:
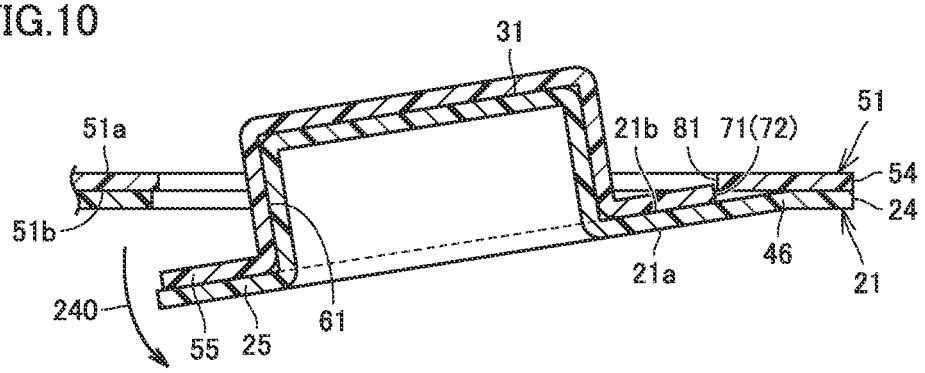
FIG. 10 is a cross-sectional view showing the first side and the second side when a package is opened.

FIG. 10 is a cross-sectional view showing the first side and the second side when the package is opened. FIG. 10 shows a cross-section of first side 21 and second side 51 within an area shown in FIG. 9.

Referring to FIGS. 3, 9, and 10, when package 10 is opened, external force is applied to first fitting portion 31 and second fitting portion 61 fitted to each other.

More specifically, force (force in a direction shown with an arrow 230 in FIGS. 3 and 9) in a direction from second side 51 toward first side 21 is applied from the side of second side 51 to second fitting portion 61 and first fitting portion 31 arranged on the inner side of second fitting portion 61. Second weak portion 71 of second side 51 is thus broken to separate second fitting portion 61 from second side 51.

At this time, as shown in FIG. 10, first side 21 is deformed as moving away from first side 21 at first weak portion 41 while first fitting portion 31 remains connected to first side 21 at rigid portion 46. As shown with an arrow 240 in FIG. 10, first side 21 is deformed in such a manner that first fitting portion 31 pivotally moves around rigid portion 46. With this deformation of first side 21, large shear force is applied to non-cut portions 76, 77, and 78 in perforated portion 72 in second weak portion 71. Therefore, second weak portion 71 can readily be broken. Package 10 can thus be prevented from greatly deforming with break of second weak portion 71 at the time of opening of package 10. Consequently, the syringe accommodated in package 10 can properly be protected.

In particular, when an article accommodated in the package is a medical product in which a drug (an anticancer drug or the like) has been loaded, the accommodated article is required to safely be handled. In the present embodiment, package 10 does not greatly deform. Therefore, drop of the syringe which is the accommodated article or leakage of a drug from the syringe during opening works can be prevented.

In general, package 10 is opened in such a posture (a posture shown in FIG. 3) that second side 51 which is the lid is overlaid from above over first side 21 provided with depression 23 where the syringe is arranged. In this case, first fitting portion 31 is in the projecting shape when viewed from second side 51 in the closed state and second fitting portion 61 is in the recessed shape when viewed from first side 21 in the closed state. Therefore, in the posture of package 10 at the time of opening, first fitting portion 31 and second fitting portion 61 are in a form projecting upward. Thus, in opening package 10, works for applying external force to first fitting portion 31 and second fitting portion 61 are readily performed.

For applying external force to first fitting portion 31 and second fitting portion 61, a manner of use to press first fitting portion 31 and second fitting portion 61 from the outside of peripheral portions 24 and 54 with a finger (thumb) is assumed. In the present embodiment, in first side 21, the length from peripheral portion 24 to first weak portion 41 (cut portion 42) is longer than the length from peripheral portion 24 to rigid portion 46. According to such a construction, first weak portion 41 (cut portion 42) separated from first side 21 is located in a region on an inner side in first side 21 far from peripheral portion 24, and rigid portion 46 that remains connected to first side 21 is located in a region on an outer side in first side 21 close to peripheral portion 24. Therefore, first fitting portion 31 and second fitting portion 61 are readily pressed with a finger (thumb).

In the closed state shown in FIG. 8, non-cut portions 76, 77, and 78 in perforated portion 72 are arranged as being superimposed on the area from first fitting portion 31 to first weak portion 41 (cut portion 42) on the surface of first side 21. In this case, first side 21 is deformed in such a manner that first fitting portion 31 separates from first side 21 at first weak portion 41 (cut portion 42). Therefore, non-cut portions 76, 77, and 78 in perforated portion 72 can readily be broken.

First weak portion 41 is formed from cut portion 42 provided by continuously cutting first side 21 along the line that goes around first fitting portion 31. Thus, when package 10 is opened, first side 21 can be deformed with weaker force to separate first fitting portion 31 from first side 21 at first weak portion 41.

Second weak portion 71 is formed from perforated portion 72 provided by intermittently cutting second side 51 along the line that goes around second fitting portion 61. Thus, while package 10 is unused, such a form that second fitting portion 61 is integrated with second side 51 is realized, whereas at the time of opening of package 10, second weak portion 71 can be broken by applying external force to first fitting portion 31 and second fitting portion 61.

First weak portion 41 and second weak portion 71 are not limited to the form of the cut portion or the perforated portion, and may be formed, for example, from a small thickness portion smaller in thickness than other portions.

Figure 11:
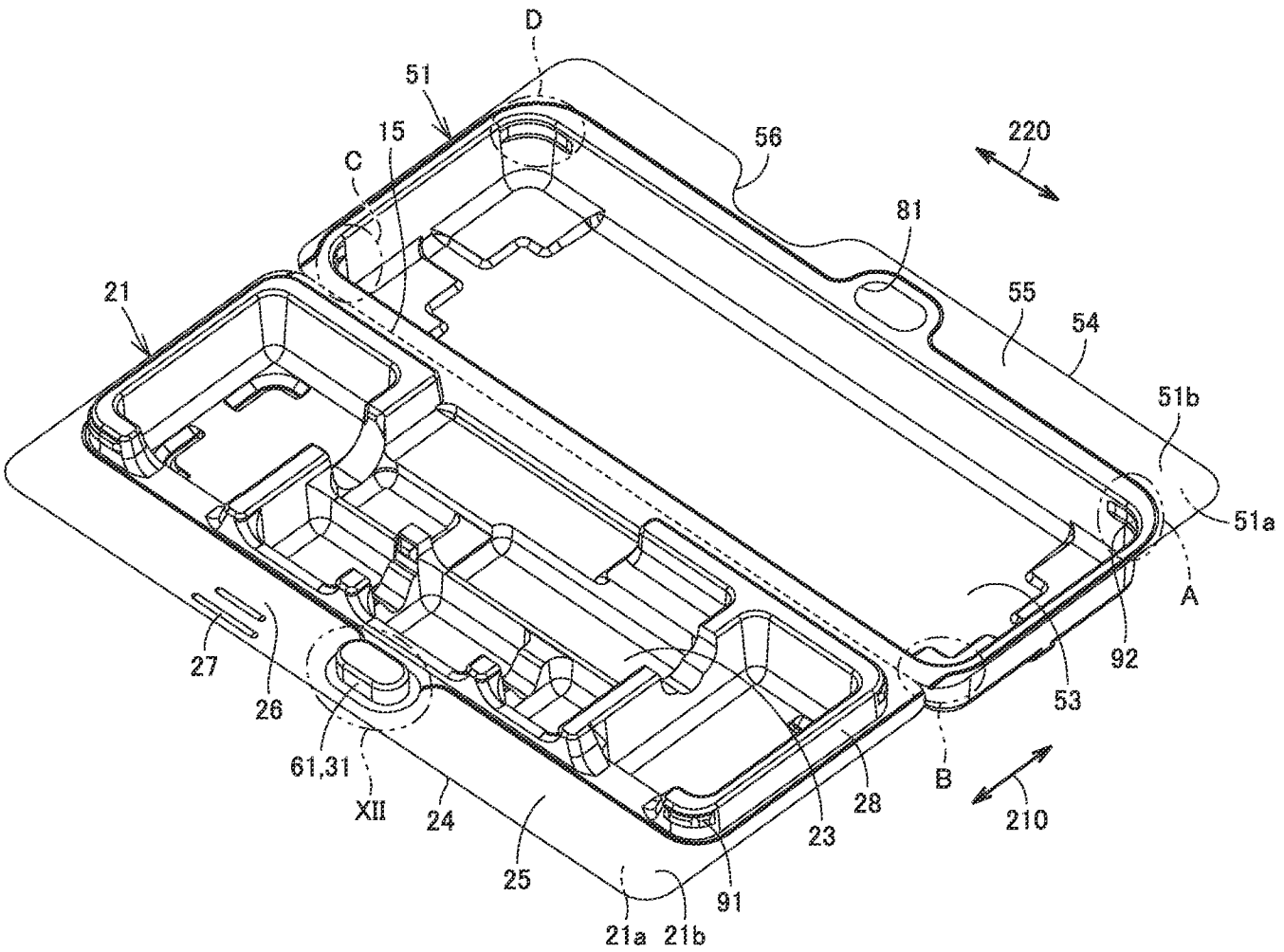
FIG. 11 is a perspective view showing the package (after it is closed) in the embodiment of this invention.
Figure 12:
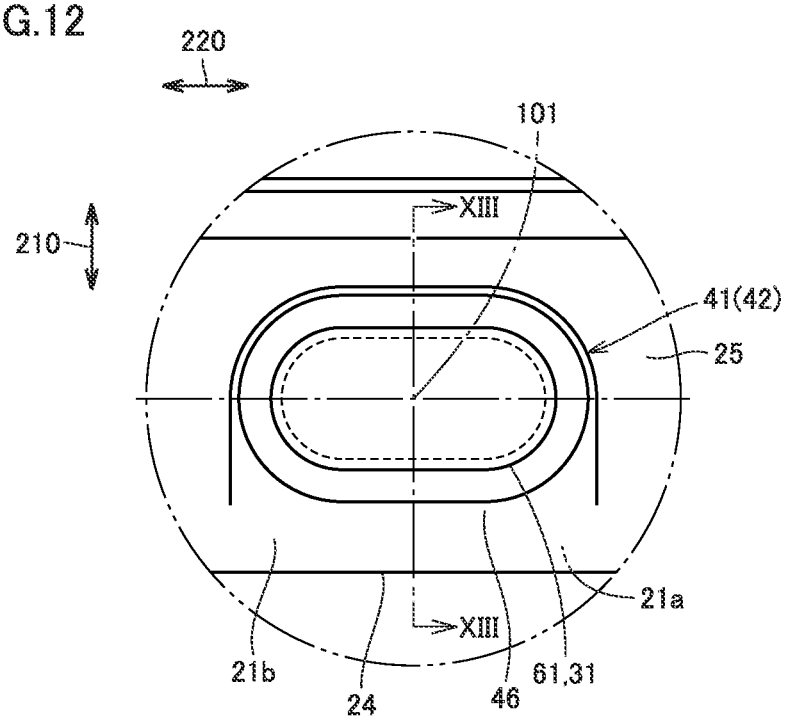
FIG. 12 is a plan view showing the first side and a second fitting portion within an area surrounded by a chain double-dotted line XII in FIG. 11.
Figure 13:
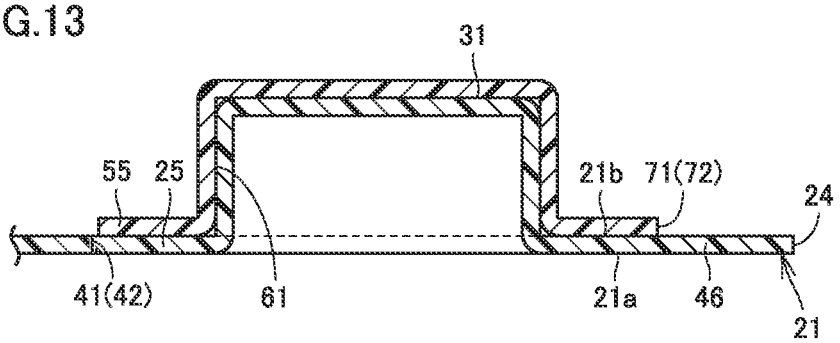
FIG. 13 is a cross-sectional view showing the first side and the second fitting portion in a direction shown with an arrow XIII-XIII in FIG. 12.

FIG. 11 is a perspective view showing the package (after it is closed) in the embodiment of this invention. FIG. 12 is a plan view showing the first side and the second fitting portion within an area surrounded by a chain double-dotted line XII in FIG. 11. FIG. 13 is a cross-sectional view showing the first side and the second fitting portion in a direction shown with an arrow XIII-XIII in FIG. 12.

Referring to FIGS. 3 and 11 to 13, second side 51 is pulled up from first side 21 while holding hold 26 of first side 21. Second side 51 is thus pivoted around hinge 15 in the direction shown with arrow 110B and package 10 is set to the opened state.

Since second weak portion 71 has been broken in the works for applying external force to first fitting portion 31 and second fitting portion 61 described previously, second fitting portion 61 remains at first side 21 as being fitted to first fitting portion 31. Second side 51 is provided with an opening 81 resulting from separation of second fitting portion 61. Since the fact of opening of package 10 can thus subsequently be confirmed, contamination or replacement of a drug in the syringe can be noticed.

When second side 51 is pulled up from first side 21 in opening package 10 without performing works for applying external force to first fitting portion 31 and second fitting portion 61 as well, force of fitting between first fitting portion 31 and second fitting portion 61 overcomes rigidity of second weak portion 71 so that second fitting portion 61 is separated from second side 51. Therefore, regardless of an opening method, the fact of opening of package 10 can subsequently be confirmed.

Figure 14:
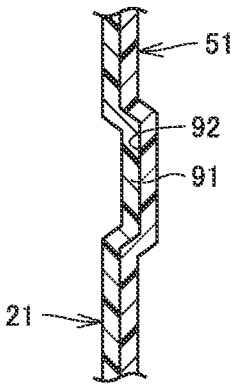
FIG. 14 is a cross-sectional view showing the first side and the second side in a direction shown with an arrow XIV-XIV in FIG. 3.

FIG. 14 is a cross-sectional view showing the first side and the second side in a direction shown with an arrow XIV-XIV in FIG. 3.

Referring to FIGS. 1, 3, and 14, first side 21 further includes a third fitting portion 91. Third fitting portion 91 is provided at a position distant from first fitting portion 31.

Third fitting portion 91 is provided at each of four corners of wall 28. Third fitting portion 91 is in a projecting shape projecting from wall 28.

Second side 51 further includes a fourth fitting portion 92. Fourth fitting portion 92 is provided at a position distant from second fitting portion 61. Fourth fitting portion 92 is provided at each of four locations (positions surrounded by chain double-dotted lines A, B, C, and D in FIG. 1) corresponding to positions where third fitting portions 91 are provided. Fourth fitting portion 92 is provided in an inner wall of depression 53. Fourth fitting portion 92 is in the recessed shape recessed from the inner wall of depression 53.

Third fitting portion 91 and fourth fitting portion 92 are fitted to each other in the closed state. According to such a construction, first side 21 and second side 51 can more reliably be held in the closed state.

Features and functions and effects of the present invention are summarized below.

A package according to this invention is a package formed from a flexible sheet material. The package includes a first side and a second side and a hinge that foldably connects the first side and the second side to each other. The first side and the second side make transition between a closed state and an opened state by pivoting around the hinge. In the closed state, a space for accommodating an article is provided. In the opened state, the space is opened. The first side includes a first fitting portion in any one of a projecting shape and a recessed shape, a rigid portion provided in a partial section on a line that goes around the first fitting portion, and a first weak portion provided in a remaining section on the line that goes around the first fitting portion and being lower in rigidity than the rigid portion. The second side includes a second fitting portion in any the other of the projecting shape and the recessed shape and fitted to the first fitting portion in the closed state and a second weak portion provided on a line that goes around the second fitting portion and being lower in rigidity than the rigid portion.

According to the package thus constructed, in opening the package, by applying external force to the first fitting portion and the second fitting portion fitted to each other, the second weak portion is broken to separate the second fitting portion from the second side. At this time, the first side is deformed such that the first fitting portion is separated from the first side at the first weak portion while it remains connected to the first side at the rigid portion. Therefore, the package can be prevented from greatly deforming with break of the second weak portion. Consequently, a package that allows subsequent confirmation of the fact of opening while it properly protects an accommodated article can be realized.

Preferably, the first side further includes a peripheral portion that defines a periphery of the sheet material at a position distant in a direction of radius from a pivot center of the first side and the second side in the hinge. The first fitting portion is provided at a position adjacent to the peripheral portion. A length from the peripheral portion to the first weak portion is longer than a length from the peripheral portion to the rigid portion.

According to the package thus constructed, when a manner of use to press the first fitting portion and the second fitting portion with a finger from the outside of the peripheral portion in opening the package is assumed, the first weak portion for separating the first fitting portion from the first side is located at a position more distant from the peripheral portion, and hence the first fitting portion and the second fitting portion are readily pressed with the finger.

Preferably, the first weak portion is provided by continuously cutting the first side along the line that goes around the first fitting portion.

According to the package thus constructed, in opening the package, the first side can be deformed with weaker force to separate the first fitting portion from the first side at the first weak portion.

Preferably, the second weak portion is provided as a perforated portion provided by intermittently cutting the second side along the line that goes around the second fitting portion.

According to the package thus constructed, while the package is unused, such a form that the second fitting portion is integrated with the second side is realized, whereas at the time of opening of the package, the second weak portion can be broken by applying external force to the first fitting portion and the second fitting portion.

Preferably, the perforated portion includes a cut portion where the second side is cut and a non-cut portion where the second side is not cut. In the closed state, the non-cut portion is arranged as being superimposed on an area from the first fitting portion to the first weak portion on a surface of the first side.

According to the package thus constructed, in opening the package, the first side is deformed to separate the first fitting portion from the first side at the first weak portion. Therefore, as the non-cut portions in the perforated portion are arranged as being superimposed on the area from the first fitting portion to the first weak portion on the surface of the first fitting portion, the non-cut portions can readily be broken.

Preferably, the first side is provided with a depression in a depressed shape in conformity with a shape of the article. The first fitting portion is in the projecting shape when viewed from the second side in the closed state. The second fitting portion is in the recessed shape when viewed from the first side in the closed state.

According to the package thus constructed, the package is opened in such a posture that the second side is overlaid from above over the first side where an article is arranged in the depression. In this case, the first fitting portion and the second fitting portion are provided to project upward. Therefore, in opening the package, works for applying external force to the first fitting portion and the second fitting portion are readily performed.

Preferably, the first side further includes a third fitting portion provided at a position distant from the first fitting portion. The second side further includes a fourth fitting portion provided at a position distant from the second fitting portion and fitted to the third fitting portion in the closed state.

According to the package thus constructed, by providing a fitting structure of the third fitting portion and the fourth fitting portion separately from the fitting structure of the first fitting portion and the second fitting portion, the first side and the second side can more reliably be held in the closed state.

It should be understood that the embodiment disclosed herein is illustrative and non-restrictive in every respect. The scope of the present invention is defined by the terms of the claims rather than the description above and is intended to include any modifications within the scope and meaning equivalent to the terms of the claims.

INDUSTRIAL APPLICABILITY

This invention is applied to a package for accommodating an article.

REFERENCE SIGNS LIST

10 package; 15 hinge; 21 first side; 21*a* first surface; 21*b* second surface; 23, 53 depression; 24, 54 peripheral portion; 25, 55 flange; 26 hold; 27 projection; 28 wall; 31 first fitting portion; 41 first weak portion; 42, 73 cut portion; 42P one end; 42Q the other end; 43 inner portion; 44, 44*p*, 44*q* outer portion; 46 rigid portion; 51 second side; 51*a* third surface; 51*b* fourth surface; 56 notch; 61 second fitting portion; 71 second weak portion; 72 perforated portion; 76, 77, 78 non-cut portion; 81 opening; 91 third fitting portion; 92 fourth fitting portion; 101, 102 central axis

The invention claimed is:

1. A package formed from a flexible sheet material, the package comprising:

a first side and a second side; and a hinge that foldably connects the first side and the second side to each other, wherein the first side and the second side transition between a closed state and an opened state by pivoting around the hinge, wherein, in the closed state, a space for accommodating an article being provided, in the opened state, the space being opened, wherein the first side includes:

a first fitting portion in any one of a projecting shape and a recessed shape, a rigid portion provided in a partial section on a line that goes around the first fitting portion, and a first weak portion provided in a remaining section on the line that goes around the first fitting portion and being lower in rigidity than the rigid portion, and wherein the second side includes:

a second fitting portion in an other of the projecting shape and the recessed shape and thus configured to be fitted to the first fitting portion in the closed state, and a second weak portion provided on a line that goes around the second fitting portion and being lower in rigidity than the rigid portion.

2. The package according to claim 1, wherein the first side further includes a peripheral portion that forms a periphery of the sheet material at a position distant in a direction of radius from a pivot center of the first side and the second side in the hinge, the first fitting portion is provided at a position adjacent to the peripheral portion, and a length from the peripheral portion to the first weak portion is longer than a length from the peripheral portion to the rigid portion.

3. The package according to claim 1, wherein the first weak portion is provided by continuously cutting the first side along the line that goes around the first fitting portion.

4. The package according to claim 1, wherein the second weak portion is provided as a perforated portion provided by intermittently cutting the second side along the line that goes around the second fitting portion.

5. The package according to claim 4, wherein the perforated portion includes a cut portion where the second side is cut and a non-cut portion where the second side is not cut, and in the closed state, the non-cut portion is arranged as being superimposed on an area from the first fitting portion to the first weak portion on a surface of the first side.

6. The package according to claim 1, wherein the first side is provided with a depression in a depressed shape in conformity with a shape of the article, the first fitting portion is in the projecting shape when viewed from the second side in the closed state, and the second fitting portion is in the recessed shape when viewed from the first side in the closed state.

7. The package according to claim 1, wherein the first side further includes a third fitting portion provided at a position distant from the first fitting portion, and the second side further includes a fourth fitting portion provided at a position distant from the second fitting portion and fitted to the third fitting portion in the closed state.

* * * * *